United States Patent [19]

Pezzana et al.

[11] 4,273,549

[45] Jun. 16, 1981

[54] PROCESS FOR MAKING MULTI-WALLED PLASTIC BAG

[75] Inventors: Francesco Pezzana, Pregnana Milanese; Cesare Quacquarella, Milan, both of Italy

[73] Assignee: W. R. Grace & Co., Duncan, S.C.

[21] Appl. No.: 52,171

[22] Filed: Jun. 26, 1979

[30] Foreign Application Priority Data

Jun. 26, 1978 [GB] United Kingdom ..... 27884/78

[51] Int. Cl.[3] ..... B31B 1/36; B31B 23/60; B31B 27/00

[52] U.S. Cl. ..... 493/196; 493/198; 493/217; 493/224; 493/267; 493/381

[58] Field of Search ..... 229/55, 62; 93/35 R, 93/8 W, 33 H, DIG. 1, 93 HT; 156/272

[56] References Cited

U.S. PATENT DOCUMENTS

| | | | |
|---|---|---|---|
| 2,260,064 | 10/1941 | Stokes | 93/35 PC X |
| 2,442,936 | 6/1948 | Rohdin | 93/35 R |
| 3,548,722 | 12/1970 | Jones et al. | 93/35 R |
| 3,552,278 | 1/1971 | Guenther | 93/35 R |
| 3,587,843 | 6/1971 | Wing | 206/57 |

FOREIGN PATENT DOCUMENTS 1252322 11/1971 United Kingdom .

*Primary Examiner*—James F. Coan

*Attorney, Agent, or Firm*—John J. Toney; Wiliam D. Lee, Jr.; Joseph P. Harps

[57] ABSTRACT

A plurality of multi-walled bags of flexible plastic material is formed by taking a longitudinally folded flat web of a first flexible plastic film; at least partially separating the superposed plies of said first flexible plastic film at the edge opposite the fold line and moving the film past a corona discharge electrode between the separated plies of the film to pre-treat at least a part of the inwardly facing surface of each of said two plies; taking a longitudinally folded flat web of a second flexible plastic film; corona discharge-treating the outwardly facing surfaces of the two plies of said second flexible plastic film; passing the pre-treated web of said second flexible plastic film over a diverter guide into the space between the two at least partially separated plies of said first flexible plastic film to bring the fold lines of the first and second flexible plastic film webs substantially into register with the two webs moving synchronously in a single direction; and sealing the composite of the two folded webs at a sealing station, along spaced transverse seal lines to form a plurality of open-ended bags having the bottom of each bag defined by the registered fold lines of the two webs and the mouth region of the bag defined at the web margin opposite the said fold line. The bags may be either wound up in a roll without severing or severed from one another and then stacked or attached to feed tapes in an imbricated way.

11 Claims, 3 Drawing Figures

PROCESS FOR MAKING MULTI-WALLED PLASTIC BAG

DESCRIPTION

The present invention relates to a multiple-walled plastics bag and to a method of and apparatus for making such a bag.

It is known to package articles, in particular food product articles, such as poultry, cuts of meat, or cheese, in plastics bags. Such bags are known, for example from U.S. Pat. No. 3,494,457 issued Feb. 10, 1970 to O. R. Titchenal and U.S. Pat. No. 3,559,800 issued Feb. 2, 1971 to J. P. Butler et al, which have a double-walled construction having one wall of high mechanical strength and the other wall providing the air-imperviousness necessary for hermetic vacuum packaging or inert gas packaging. It is also known to bond the plies of multi ply bags using corona discharge treatment (see British Patent No. 1,252,322 issued to Windmoeller and Hoelscher).

We now propose to provide a double-walled bag of flexible plastic film having a neck-defining portion of single-walled construction and a product-enclosing portion of multiple-walled construction.

Particularly conveniently such a bag has been formed by the superposition of two or more plies of flexible plastic film after pre-treating of the plies on those faces destined to come into contact with one another in the finished bag, to ensure bonding at the interface between the superposed plies. It is particularly convenient to employ corona discharge treatment as a pre-treating step to ensure bonding of the film plies.

Suitably the inner layer of flexible plastic material may have a depth on one side which is larger than the depth of the other side (where the term "side" is used to denote the area bounded by a closed bottom edge of the bag, two parallel side edges of the bag, and a fourth edge spaced from the said closed bottom edge and where the "depth" is the dimension measured between the bottom edge and said fourth edge). In such a construction the depth of both the sides of the inner bag will be less than the depth of the sides of the outer bag, which may conveniently be equal.

Such a bag may be loaded with a food or other article and may be closed by any suitable means, for example by clipping or heat-sealing, at the mouth region of the bag.

The invention also provides a process for manufacturing a plurality of multi-walled bags of flexible plastic material comprising: taking a longitudinally folded flat web of a first flexible plastic film; at least partially opening the superposed plies of said first flexible plastic film at the edge opposite the fold line and arranging for relative movement between a corona electrode and the film along the film to pre-treat at least a part of the inwardly facing surface of each of said two plies; taking a longitudinally folded flat web of a second flexible plastic film; pre-treating the outwardly facing surfaces of the two plies of said second flexible plastic film; passing the pre-treated web of said second flexible plastic film over a diverter guide into the space between the two at least partially opened plies of said first flexible plastic film to bring the fold line between the said two plies of said second flexible plastic film at least substantially into register with the fold line of the said two plies of said first flexible plastic film with the two webs moving synchronously in a single direction; and sealing the composite of the two folded webs at a sealing station, along spaced seal lines extending transversely of the said direction of movement of the two webs to form a plurality of open-ended bags having the bottom of each bag defined by the said at least substantially registered fold lines of the two webs and the mouth region of the bag defined at the web margin opposite the said fold lines. If desired the webs may be severed to separate the thus-formed bags from one another.

Conveniently the longitudinally folded film webs may be formed by slitting one edge of a flat tubular film.

After separation, the bags may conveniently be attached to tapes for forming a chain of imbricated bags for supply to a loading station. On the other hand, the bags may simply be stacked for placing in a container for storage and/or transport to a user location. Alternatively the roll of welded bags may be wound up, without severing, for storage and/or shipping.

Conveniently, while the two webs are moving in a single direction between the said diverter guide and the sealing station, the free marginal edges of said second flexible plastic film web are closer to the substantially registered fold lines than are the free marginal edges of the said first flexible plastic film web.

Advantageously at least one of the webs may have its free edges mutually displaced so that one free edge is further from the fold line than is the other free edge.

In a particularly convenient process said first flexible plastic film forming the outer bag material is a barrier film to impart gas-imperviousness characteristics to the finished bag, and said second flexible plastic film forming the inner bag material is a material which enhances the mechanical strength of the finished bag. The said first flexible plastic film web may then have its free edges superposed and hence at a common spacing from the fold line of that web while said second flexible plastic film web has its free marginal edges displaced from one another so as to be at different respective spacings from the fold line of that web, such that the common spacing of the free edges of the "outer bag material" is greater than either of the said different respective spacings of the inner bag material.

The present invention also provides apparatus for forming multi-walled bags comprising means for supplying a longitudinally-folded web of a first flexible plastic film; corona discharge-treatment means arranged to discharge-treat the inwardly facing surfaces of a first flexible plastic film fed by said supplying means; means for supplying a second longitudinally-folded web of flexible plastic film along a direction which is perpendicular to or inclined with respect to the direction of passage of said first flexible plastic film web but with the second flexible plastic film web substantially coplanar with the median plane of said first flexible plastic film web; a diverter guide for diverting the direction of movement of said second flexible plastic film web to a direction which is common to the first flexible plastic film web, said diverter guide being positioned between the position to be occupied by the plies of the said first flexible plastic film web; a sealing station for creating longitudinally spaced transverse seal lines across the composite flat-folded four-ply film; and means for separating the thus-formed bags from one another.

If desired, means may be provided for feeding a third or subsequent centre-folded film into the space between the already superposed and discharge-bonded plies forming a multi-ply flat-folded web, between said diverter means and said sealing station, for permitting a composite bag of three- or more-walled construction to be produced.

In order that the present invention may more readily be understood the following description is given, merely by way of example, reference being made to the accompanying drawings in which.

Figure 1:
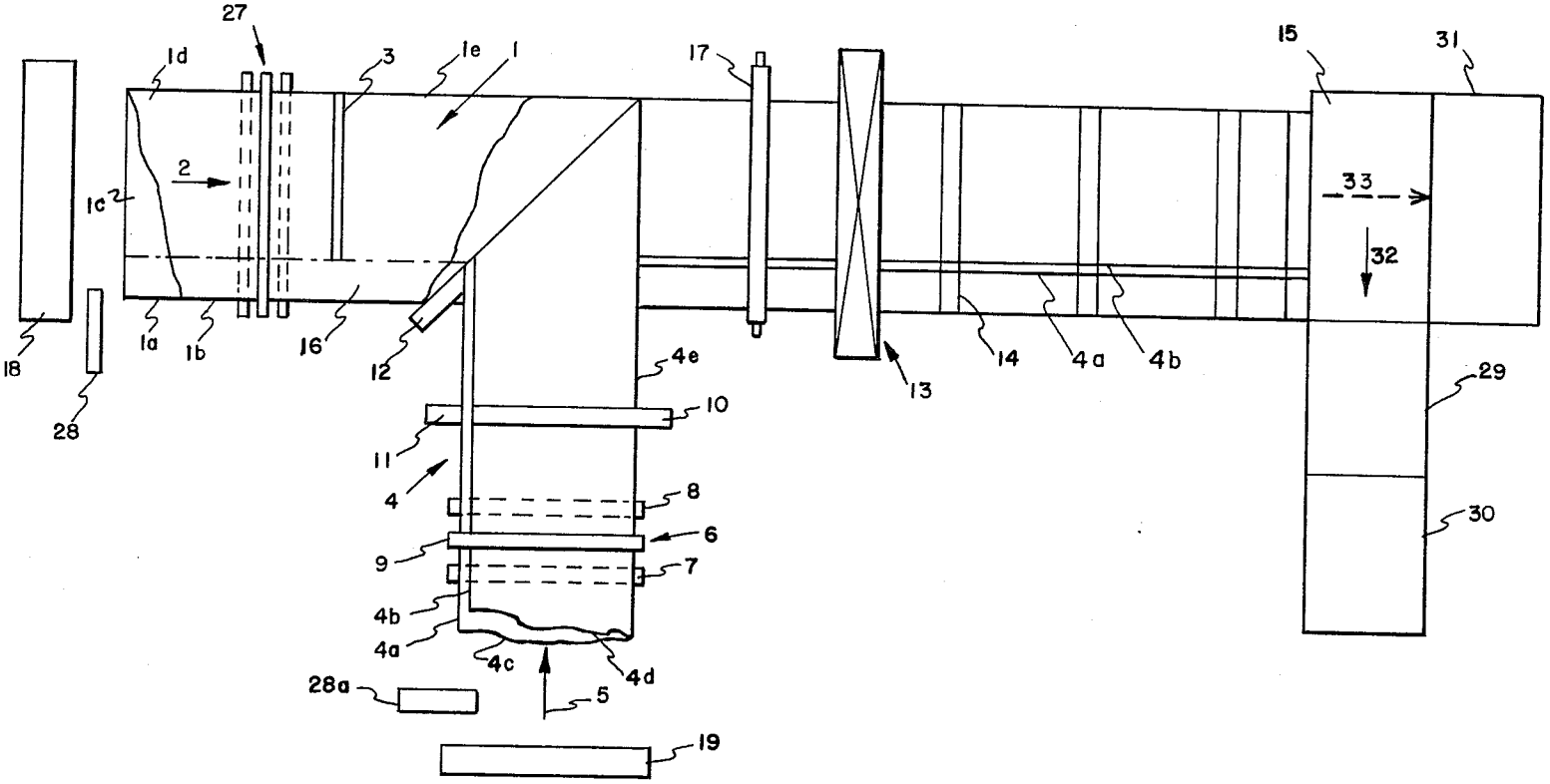
FIG. 1 is a top plan view, in schematic form, showing apparatus for preparing double-walled bags for packaging purposes.
Figure 2:
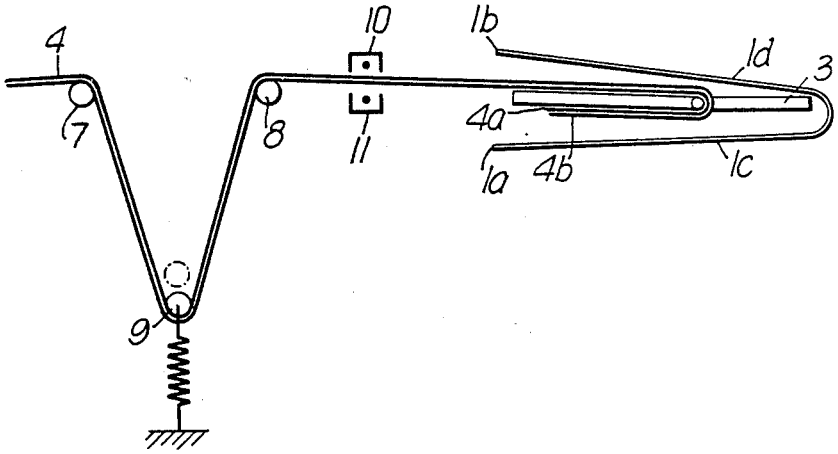
FIG. 2 is a transverse sectional view taken on the line II—II of FIG. 1.
Figure 3:
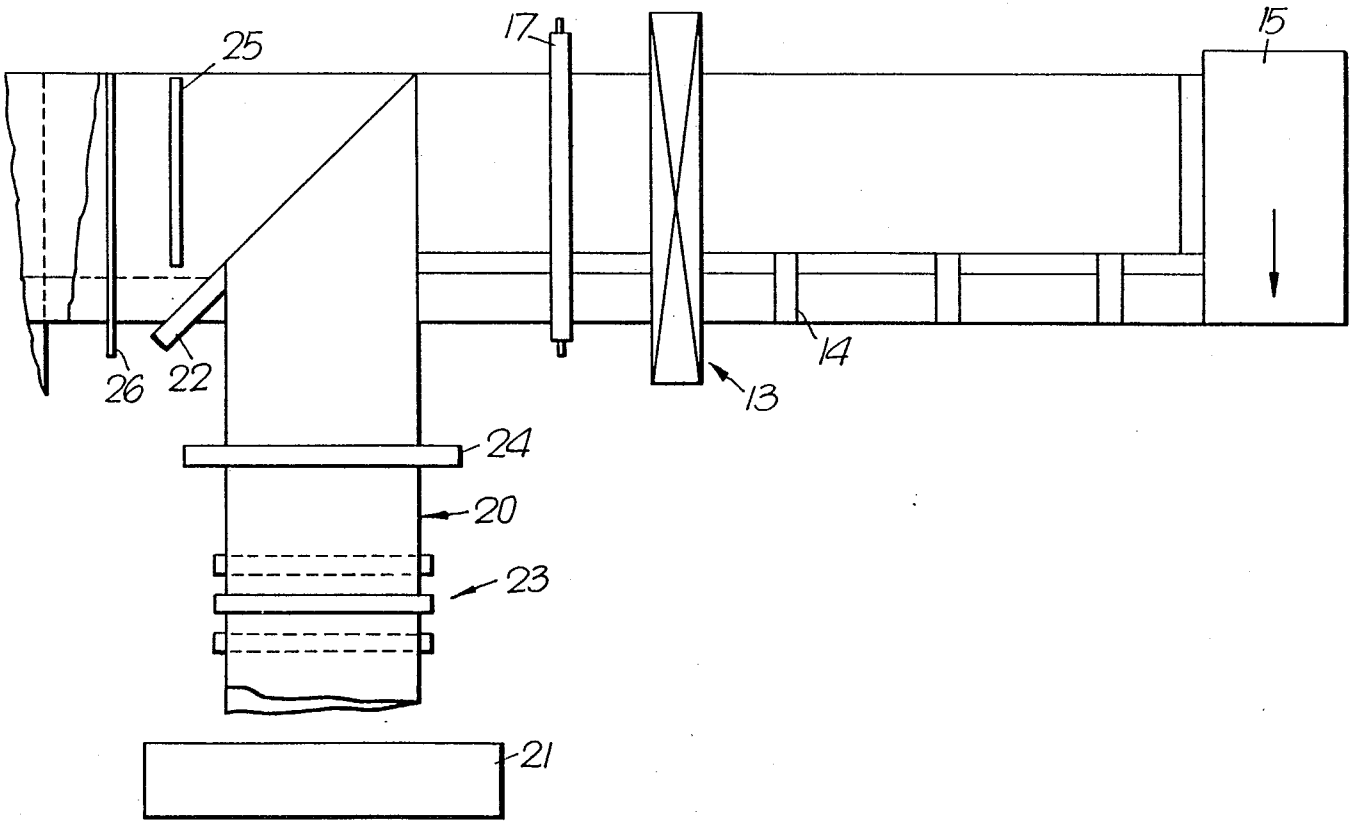
FIG. 3 is a view corresponding to a detail of FIG. 1, but showing an alternative embodiment of apparatus in which a three ply bag is to be produced.

As shown in FIG. 1, a longitudinally folded, in this case centre-folded, web 1 of "outer bag material" (in this case extruded "BB1" tubing manufactured by W. R. Grace & Co.) is fed from supply means 18 along a direction represented by arrow 2 and is arranged so that the superposed lateral edges 1*a* and 1*b* of the plies 1*c* and 1*d*, respectively, are directly one above the other, in other words they are equidistant from the fold line 1*e*. As shown in FIG. 2, the plies 1*c* and 1*d* are held apart to an extent sufficient to allow them to pass to either side of (in other words one above and one below) a corona discharge treatment electrode 3 which pre-treats part of the inwardly facing surfaces of the plies 1*c* and 1*d*.

The corona treatment electrode 3 must only extend over a part of the width of the centre-folded web 1 so as to treat only that portion of each of the inwardly facing surfaces of plies 1*c* and 1*d* which, in the folded and flattened configuration of the composite web, will come into contact with the web 4. Otherwise, if the mouth region 16 of the composite web 1, 4 were to be surface-treated on the inwardly facing surfaces then the mouth of the bag would close when the webs are pressed together and it would not be possible to open the bag for subsequent use.

Prior to corona discharge treatment the web 1 passes over a tension control device 26.

As also shown in FIG. 1, a second longitudinally-folded film 4 consisting of superposed plies 4*c* and 4*d* having free edges 4*a* and 4*b*, respectively, is fed from supply means 19 in a horizontal direction 5 perpendicular to the direction 2. This second longitudinally folded web 4, which may be centre-folded, but is in this case folded slightly off-centre, will form the "inner bag material" of the finished bag and has the free edges 4*a* and 4*b* at slightly different spacings from the fold line 4*e* for a purpose which will be explained later.

The film 4 also passes over a tension control roller device 6 which, as shown in more detail in FIG. 2, consists of horizontally spaced upper rolls 7 and 8 and an underneath vertically movable dancing roll 9 spring loaded in the downward direction to maintain tension on the web. The device 27 operates on web 1 in a analogous manner.

From the tension control roll device 6, the web 4 passes between upper and lower corona discharge treatment devices 10 and 11 which pre-treat the outwardly facing surfaces of the two plies 4*c* and 4*d* of the inner bag material. In this example, the inner bag material is a EVA film available from W. R. Grace & Co. as "E-bag" tubing.

If desired, each of the feed paths for the film material, shown in FIG. 1, may include slitters 28 and 28A which take an input material of continuously extruded tubular film, extruded "BB1" in the case of the outer web 1 and "E-bag" tubing in the case of inner web 4, and slits that tubing along one edge such that the web 1 has the two slit edges 1*a* and 1*b* directly superposed, as explained above, and the web 4 has its slit edges 4*a* and 4*b* staggered, in this case by a distance of approximately 4 mm measured in terms of the difference between the respective spacings of the edges 4*a* and 4*b* from the fold line 4*e*. The stagger of the edges 4*a* and 4*b* may, if desired, be as much as 1 cm.

The discharge treatment devices 10 and 11 are such that the lower device, 11, extends over the entire width of the web 4 and hence pre-treats the whole of the downwardly facing surface of ply 4*c*, whereas the upper device 10 terminates at the edge 4*b* of the upper ply 4*d* so that there is no possibility of the device 11 pre-treating the upwardly facing marginal portion of the ply 4*c* which overhangs beyond edge 4*d*.

From the pre-treating devices 10 and 11, the "inner bag material" web 4 passes to a diverter guide 12, in this case a narrow diameter guide bar having its axis horizontal and extending at an inclination of substantially 45° to the direction 2 of the movement of the "outer bag material" web 1. This diverter guide bar 12 is supported in cantilever fashion from a position outside the space between the plies 1*c* and 1*d* of the "outer bag material" web 1 and terminates very close to the fold line 1*e* of the web 1 so that the web 4 of the "inner bag material" is diverted to pass along the same direction 2 as the centre-folded "outer bag material" web 1 with the fold line 4*e* of the "inner bag material" substantially coincident with the fold line 1*e* of the "outer bag material". Suitable web control means may, if desired, be included for controlling the position of web 4 on the bar 12.

A pair of pinch rolls 17, immediately downstream of the diverter guide 12 and before the sealing station, serves to press together the four plies of the composite web 1, 4 so as to bring the pre-treated surfaces of the various plies into contact with one another to cause them to bond in a non-releasable manner.

As shown in the sectional view of FIG. 2, and also schematically in the top plan of FIG. 1, the composite four-ply web now has the two edges 1*a* and 1*b* of the outer web 1*e* and the two edges 4*a* and 4*b* of the inner web 4 at different and smaller spacings from the fold line 1*e*.

The purpose of this staggering of the edges 4*a* and 4*b* of the inner web 1*a* and 1*b* is to ensure that, in the finished bag, the outer bag material has both sides of the same height (i.e. the same distance between on the one hand the fold line forming the bottom edge of the tube and on the other hand the respective slit edges 1*a* and 1*b* forming the periphery of the bag mouth), and also that the inner bag has its sides of slightly different heights. This ensures that during the next step of the operating phase, namely transverse welding at the sealing station, the sealing jaws 13 will have a first zone at which they are clamped against four plies (1*c*, 4*d*, 4*c* and 1*d*), a second adjacent region at which they are clamped about three plies. (1*c*, 4*c* and 1*d*) and a third region, 16 in FIG. 1, where they are clamped about only two plies (1*c* and 1*d*).

Although it is within the scope of the present invention for the two edges 4*a* and 4*b* to be directly in register so that there will be one region where four plies (1*c*, 4*d*, 4*c* and 1*d*) are clamped and a second region 16 where the clamping pressure is applied to only the two outer plies 1*c* and 1*d*, the transition between the "four-ply" clamping region and the "two-ply" clamping region is eased if an intermediate "three-ply" clamping region is provided.

The need for a region 16 at which only two-plies 1*c* and 1*d* are clamped together arises because of the desirability of providing one of the bags of a height different from that of the other bag so that, in the article-enclosing region of each finished bag, the composite bag will include two plies (1*c* and 4*c* on the one hand and 1*d* and 4*d* on the other hand), whereas in the mouth region 16 of the bag the wall will only have one ply (1*c* or 1*d*, respectively), and this will facilitate sealing. For example, where the finished bag is to be sealed by the attachment of a deformable metallic clip, the mass of the film material to be placed within the clip, i.e. between the two legs of the clip before deformation, is kept to a minimum. Also, it is the "BB1" material which is gripped in the clamping region and not the "E-bag" material which will not have the same air-imperviousness characteristics.

The welding jaws 13 comprise the conventional upper and lower sealing jaws having heating means for applying heat to the clamped regions of the two-, three-, or four-ply film therebetween so as to heat-seal each pair of contiguous plies to leave the four plies 1*c*, 4*d*, 4*c* and 1*d* sealed together as an integral structure at the transverse seal line 14.

The feed of the "outer bag material" web 1 is intermittent so as to permit the sealing jaws 13 to clamp and hold the various plies of film together for a suitable dwell time to ensure adequate sealing and then to permit advance of the web 1 through an increment equivalent to the width of a finished bag before the next weld line 14 is formed.

At the optional bag separating station 15 illustrated schematically in FIG. 1, the bags are severed along the individual weld lines 14 so as to separate one bag from the next and the bags can then be delivered (see arrow 32) to a stacking 29 or taping 30 station for stacking into a container for shipment and/or storage or for application to support tapes, for example two adhesive-coated tapes, which will support the finished bags in imbricated form for feeding to an automatic bag loader, for example the automatic bag loader disclosed in our U.S. Pat. Nos. 3,552,090, 3,587,843, 3,587,844 and 3,587,845.

If desired, the roll of bonded and welded bags may be rolled (see arrow 33) up onto a storage/shipment support roll 31 for severing at the location of use.

The apparatus illlustrated in FIGS. 1 and 2 has been used successfully in tests to produce a composite bag of which the outer bag material (web 1) was of slit "BB1" tubing 2.4 mils (0.061 mm) in thickness and a "inner bag material" (web 4) of slit "E-bag" tubing, (irradiated EVA/EVA), having a thickness of 3 mils (0.076 mm).

The corona treatment devices were energised by a 1,000 watt generator and applied an energy intensity sufficient to give a surface tension of 55 dynes per cm. to the bond between the pre-treated contacted layers, 1*c* and 4*d* on the one hand, and 1*d* and 4*c* on the other hand.

The width of the marginal portion 16 defining the mouth region of the finished bag was approximately 5 inches (12.7 cm) in order to give the optimum size of the "one-ply" mouth region for ease of clipping.

Preferably the bond between the inner and outer plies of the composite bag should be of the order of 20 grams per inch (7.9 grams per cm) for optimum results.

In the composite bag described above, the "E-bag" material can be printed in which case the transparency of the "BB1" material of the outer web 1 will enable the printing to be seen from outside the bag and this "sandwich printing" configuration will protect the printed material from erosion during use of the bag.

Although it is preferred that both the inner bag material and the outer bag material be of shrinkable type, it is envisaged that one or both of the bag materials may be non-shrinkable. In the case of having only one of the bag materials non-shrinkable it would be preferable for the inner bag to be non-shrinkable in which case the shrinking carried out on the outer bag material would serve to contract the composite bag into intimate contact with the product article inside the inner bag.

Apart from the "BB1" material used for the outer bag in the example described, other possible materials include slit "E-bag" tubing, slit "BK-bag" tubing, and slit "super L" tubing (all available from W. R. Grace & Co.). Similarly, the material for the inner bag may be slit "E-bag" tubing, polyethylene of low density, medium density or high density, polypropylene "Surlyn" or "XU" (both the latter being available from W. R. Grace & Co.).

In order to afford an appreciable increase of resistance to abuse of the bag it is desirable that the strength-enhancing layer (in the specific example the "E-bag" tubing of web 4) should have a thickness of at least 2 mils (0.045 mm) although it should be borne in mind that keeping the thickness below a level above 5 mils (0.127 mm) or more preferably 4 mils (0.102 mm) may avoid an excessive penalty in terms of the expense of ensuring adequate impulse sealing by jaws 13 at the side sealing station.

In the example described above, the aim is to avoid damage of the bag due to sharp projections on the internal surface, and for this reason the strength-enhancing "E-bag" material is on the inside. However, where it is desirable for the bag to be protected against damage from outside, the strength-enhancing material will be chosen for the outer web 1 and the gas-tight material (e.g. "BB1") for the inner web 4. In such a case, it will be desirable for the inner web 4 to be wider than the outer web 1 if the barrier properties of the inner web 4 are to extend right up to and over the neck region of the bag.

The choice of particular materials for the inner and/or outer bag layers is well within the ability of the skilled expert in the art of manufacturing and using packaging bags.

Although, as described above, the invention has been exemplified in the context of a double bag construction, it is of course conceivable for the bag to consist of three separate layers, if desired. For example the bag may employ a barrier layer sandwiched between an outer strength-enhancing layer and an inner strength-enhancing layer where damage from both within and outside the bag is to be avoided. In this situation, one possible arrangement is for the web 1 to be of strength-enhancing material and have a width which is less than the width of the web 4 which will be the barrier layer. The further web 20, is introduced from supply means 21 to a location within the web 4 between the diverter guide 12 and the pinch rolls 17, by means of another diverter guide 22 with tension control roller arrangement 23 and with external pre-treatment corona discharge means 24 similar to the pair of devices 10 and 11 of FIG. 1. This third film 20 is then pressed into contact with the inwardly facing surfaces of the plies 4c and 4d of the web 4 at the pinch rolls 17. In this case, it is necessary additionally to incorporate a further internal corona discharge device 25 in the path of the web 4 downstream of the first diverter guide 12 (analogous to the internal treatment device 3 of FIG. 1) in order to ensure that the inwardly facing surfaces of the plies 4c and 4d of the web 4 are pre-treated to receive and to bond to the outwardly facing surfaces of the third and innermost web 20. A separator 26 just ahead of the corona device 25 spaces the plies of the web 20 just prior to treatment.

The purpose of the tension control roller arrangements 6, 23, 27 shown in FIGS. 1 and 2 is to ensure that the tension is controlled within desired limits in that in response to movement of the dancing roller 9 the supply of that web is controlled in order to endeavour to compensate for fluctuations in the tension in the respective web 1, 4 and 20.

We claim:

1. A process for manufacturing a plurality of multi-walled bags of a flexible plastic material comprising: taking a longitudinally folded flat web of a first flexible plastic film; at least partially opening superposed plies of said first flexible plastic film at a web margin opposite a fold line and establishing a relative movement between a corona discharge electrode and the first plastic film in a direction along the film to pre-treat at least a part of an inwardly facing surface of each of said superposed plies; taking a longitudinally folded flat web of a second flexible plastic film, a transverse dimension of said second flexible plastic film being less than a transverse dimension of said first flexible plastic film; pre-treating outwardly facing surfaces of two plies of said second flexible plastic film; passing a pre-treated web of said second flexible plastic film over a diverter guide into a space between the at least partially opened plies of said first flexible plastic film to bring a fold line of the second flexible plastic film between the said two plies of said flexible plastic film at least substantially into register with the fold line between the partially opened plies of said first flexible plastic film with said two webs moving synchronously in a single direction; and sealing a composite of the two folded webs at a sealing station along a spaced seal line extending transversely of the said direction of movement of the two webs to form a plurality of open-ended bags having a bottom of each bag defined by said at least substantially registered fold lines of the two webs and a mouth region of each bag defined by said first flexible plastic film at a web margin opposite the fold lines in an area of dimension which is greater than a dimension of said second flexible plastic film whereby said mouth is defined only by said first flexible plastic film.

2. A process according to claim 1, wherein at least one of the longitudinally folded film webs is formed by slitting an edge of a flat tubular film.

3. A process according to claim 1, and including the step of severing the webs to separate the thus-formed bags from one another.

4. A process according to claim 3 comprising, after the severing step, the further step of stacking the bags for placing in a container for storage and transporting to a user location.

5. A process according to claim 1, wherein the welded bags are wound up without severing from one another, for storage and shipping.

6. A process according to claim 1 or 2 or 3 or 4 or 5, wherein, while the two webs are moving in a single direction between the said diverter guide and said sealing station, the free edges of said second flexible plastic material are closer to the registered fold lines than are the free edges of said first flexible plastic film.

7. A process according to claim 1 or 2 or 3 or 4 or 5, and including the step of controlling the tension in each said web prior to bringing said fold lines substantially into register with one another.

8. A process according to claim 1 or 2 or 3 or 4 or 5, wherein said first flexible plastic film is a barrier film to impart gas-imperviousness characteristics to the finished bag, and said second flexible plastic film is of a material which enhances the mechanical strength of the finished bag.

9. A process according to claim 3, comprising, after the severing step, the further step of attaching the bags to tapes for forming a chain of imbricated bags for supply to a loading station.

10. A process according to claim 1 or 2 or 3 or 4 or 5 or 9, wherein at least one of the webs has its two free marginal edges mutually displaced so that one free marginal edge of that web is further from the fold line than is the other free marginal edge of that same web.

11. A process according to claim 10, wherein said first flexible plastic film web has its free marginal edges superposed and hence at a common spacing from the fold line of said first flexible plastic film web while said second flexible plastic film web has its free marginal edges laterally displaced from one another so as to be at different respective spacings from the fold line of said second flexible plastic film web, such that said common spacing of the free edges of said first flexible plastic film web is greater than either of said different respective spacings of said second flexible plastic film web.

* * * * *